US010719042B2

(12) United States Patent
Hirayama et al.

(10) Patent No.: US 10,719,042 B2
(45) Date of Patent: Jul. 21, 2020

(54) IMAGE HEATING APPARATUS

(71) Applicant: CANON KABUSHIKI KAISHA, Tokyo (JP)

(72) Inventors: Taiya Hirayama, Moriya (JP); Koji Takematsu, Abiko (JP); Kenichi Tanaka, Ushiku (JP); Takeshi Kozuma, Abiko (JP); Atsushi Ishigami, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 93 days.

(21) Appl. No.: 15/964,426

(22) Filed: Apr. 27, 2018

(65) Prior Publication Data

US 2018/0314193 A1 Nov. 1, 2018

(30) Foreign Application Priority Data

Apr. 28, 2017 (JP) ..... 2017-089469
Mar. 30, 2018 (JP) ..... 2018-067316

(51) Int. Cl.
*G03G 15/20* (2006.01)
*G03G 15/00* (2006.01)

(52) U.S. Cl.
CPC ..... *G03G 15/205* (2013.01); *G03G 15/2039* (2013.01); *G03G 15/2053* (2013.01); *G03G 15/70* (2013.01); *G03G 2215/00548* (2013.01); *G03G 2215/2019* (2013.01)

(58) Field of Classification Search
CPC ..... G03G 15/00; G03G 15/20; G03G 15/205; G03G 15/2039; G03G 15/2053; G03G 15/70; G03G 21/14; G03G 2215/00548; G03G 2215/2019
See application file for complete search history.

(56) References Cited

U.S. PATENT DOCUMENTS

| | | | | |
|---|---|---|---|---|
| 7,262,391 | B2 | 8/2007 | Nishihara et al. | |
| 7,890,038 | B2 | 2/2011 | Chikugo et al. | |
| 9,104,148 | B2 | 8/2015 | Hasegawa | |
| 9,389,554 | B2 | 7/2016 | Tanaka et al. | |
| 9,563,163 | B2 | 2/2017 | Tanaka et al. | |
| 2009/0180793 | A1* | 7/2009 | Fujino | G03G 15/2064 399/68 |
| 2011/0026960 | A1* | 2/2011 | Okamoto | G03G 15/206 399/67 |
| 2011/0188872 | A1* | 8/2011 | Nara | G03G 15/20 399/67 |

FOREIGN PATENT DOCUMENTS

JP 2013-190774 A 9/2013

* cited by examiner

*Primary Examiner* — Nguyen Q. Ha
(74) *Attorney, Agent, or Firm* — Venable LLP

(57) ABSTRACT

An image heating apparatus including a rotatable heating member, a first motor configured to rotationally drive the rotatable heating member, a belt unit, a position detecting portion, a tilting mechanism, including a second motor for tilting the belt unit, a jam detecting portion, and a controller. When the occurrence of the jam is detected by the jam detecting portion during a tilting operation of the belt unit, the controller stops drive of the first motor and drive of the second motor in response to detection of the occurrence of the jam by the jam detecting portion.

20 Claims, 8 Drawing Sheets

REPLACEMENT SHEET

PRIOR ART

IMAGE HEATING APPARATUS

CROSS-REFERENCE TO RELATED APPLICATIONS

This application claims the benefit of Japanese Patent Application No. 2017-089469, filed on Apr. 28, 2017, and No. 2018-067316, filed on Mar. 30, 2018, which are hereby incorporated by reference herein in their entireties.

FIELD OF THE INVENTION AND RELATED ART

The present invention relates to a fixing device (image heating apparatus) capable of being used in an image forming of an electrophotographic type or an electrostatic recording type, for example. Such image forming apparatuses include a printer, a copying machine, a facsimile machine or a multi-function machine having a plurality of functions of these machines, for example.

Conventionally, various image forming apparatuses have been known, but the image forming apparatus of the electrophotographic type has become widespread. Such an image forming apparatus is required to provide high productivity (large print number per unit time) for various recording materials (hereafter referred to as sheets) such as thick paper.

In the image forming apparatus of the electrophotographic type as described above, increasing a fixing speed of the fixing device has been required in order to improve the productivity of the image forming apparatus. When the number of sheets of thick paper passed through the fixing device per unit time is increased, a large amount of heat is taken from a surface of a fixing roller (rotatable heating member), as thick paper has a larger thermal capacity.

One method of fixing an image on the thick paper without lowering the productivity for the thick paper is an external heating type. In this method in a high-temperature member is contacted to an outer surface of the fixing roller, and the high-temperature member thus heats the fixing roller. In one such method the high-temperature member is an external heating belt. The external heating belt is an endless belt that is stretched around two supporting rollers. Each supporting roller includes a heating source. When the external heating belt is contacted to the fixing roller, a large nip is formed depending on a winding angle of the belt, and therefore, heat of the supporting rollers can be efficiently conducted to the fixing roller through the belt.

The following method of controlling a shift of such a belt has been proposed. In this method, a belt unit is rotated, forming a crossing angle between a rotational axis of the fixing roller and a rotational axis of a supporting roller. A shifting speed is thus generated in the belt rotated by the fixing roller. A detecting means may be used to detect an end portion of the belt. When a position of a belt end surface arrives at one end of a belt shift width, the belt unit is rotated in a direction in which the crossing angle between the rotational axes of the fixing roller and the supporting roller is reversed, so that a shift direction is reversed.

According to this method, there is no need to provide a steering roller in addition to the supporting rollers to generate a shift in the external heating belt. Thus, shift control can be carried out with a simple construction (Japanese Laid-Open Patent Application (JP-A) 2013-190774).

The external heating belt disclosed in JP-A 2013-190774 includes heaters with a large output since a large heating nip is formed by an angle of winding of the belt about the fixing roller. With the large heating nip a large heat quantity can be efficiently transmitted to the fixing roller. The heat conduction path from the supporting rollers to the fixing roller is cut off when the belt is spaced apart from the fixing roller. A surface temperature of the belt may overshoot a target temperature during a heating operation with the belt spaced from the fixing roller. A thermo-switch is contacted to the belt surface, and when the thermo-switch is actuated by a high temperature due to the overshoot, electric power supply to the heater is cut off. As a result, a fixing operation cannot be continued.

In order to avoid this problem, the belt is kept contact with the fixing roller even after the the fixing roller is is stopped due to an unexpected cause such as a sheet jam. As a result, heat accumulated in the supporting rollers is conducted to the fixing roller, so that the overshoot of the belt surface temperature is suppressed.

In the fixing device disclosed in JP-A 2013-190774, a rotational drive operation of the fixing roller and a shift control operation of the belt are independently carried out. In the shift control operation of the belt, a steering motor, which is a driving means for rotating the belt unit, is rotationally driven by a predetermined angle on the basis of a signal of the detecting means, so that the shift direction of the belt is reversed. As discussed above the detecting means detects the arrival of the belt end surface at one end of the shift width. During the fixing operation of the fixing device, the belt is repetitively subjected to the above-described shift control operation, so that a shift operation in which the belt reciprocates in a predetermined shift width is carried out.

When the jam is detected during the fixing operation, a fixing drive motor immediately reduces speed and stops after a lapse of a predetermined time. On the other hand, the steering motor of the external heating belt unit is stopped, independently of the operation of the fixing driving motor, after the steering motor is driven from a point of time of the belt end surface detection by a predetermined angle, and therefore, also after the stop of the fixing driving motor, the case when the drive of the steering motor is continued exists.

An operation in the case when a conventional fixing device, including an external heating belt unit is stopped due to emergency, such as a sheet jam, is shown in FIG. 8. When the jam is detected at a time Tj, the fixing driving motor reduces speed and stops after a lapse of time T1. On the other hand, the external heating steering motor is driven from the point of time of the belt end surface is detected. In the example shown in FIG. 8, the drive of the external heating steering motor is thus continued for a time Ta even after the the fixing roller is stopped.

In this case, one portion of the fixing roller is at rest, and the high-temperature external heating belt unit is rotated, generating local heating and friction at a contact portion between the external heating belt and the fixing roller surface. As a result, if scars or creases are generated on a surface layer of the fixing roller, the scars or creases are transferred onto a toner image on a sheet in a subsequent fixing operation, so that a quality of a product is lowered.

SUMMARY OF THE INVENTION

In order to solve the above-described problem, a principal object of the present invention is to provide an image heating apparatus, including an endless belt for heating a rotatable heating member, capable of preventing generation of damage such as scars or creases on a rotatable heating member surface layer even in the case when an operation of the image heating apparatus is stopped due to an unexpected cause.

According to an aspect, the present invention provides an image heating apparatus including a rotatable heating member, a first motor, a belt unit, a position detecting portion, a tilting mechanism, a jam detecting portion, and a controller. The rotatable heating member is configured to heat a toner image on a recording material. The first motor is configured to rotationally drive the rotatable heating member. The belt unit includes an endless belt configured to heat the rotatable heating member in contact with an outer peripheral surface of the rotatable heating member. The belt unit also includes first and second supporting rollers configured to rotatably support the endless belt. The position detecting portion is configured to detect that the endless belt is deviated from a predetermined zone with respect to a widthwise direction of the endless belt. The tilting mechanism includes a second motor as a driving source for tilting the belt unit and is configured to tilt the belt unit in a direction for returning the endless belt to the predetermined zone in response to an output of the position detecting portion. The jam detecting portion is configured to detect occurrence of a jam. The controller is configured to control the first and second motors. When the occurrence of the jam is detected by the jam detecting portion during a tilting operation of the belt unit, the controller stops drive of the first motor and drive of the second motor in response to detection of the occurrence of the jam by the jam detecting portion.

According to another aspect, the present invention provides an image heating apparatus including a rotatable heating member, a belt unit, a position detecting portion, a tilting mechanism, and a jam detecting portion. The rotatable heating member is configured to heat a toner image on a recording material and configured to be rotationally driven by a first motor. The belt unit includes an endless belt configured to heat the rotatable heating member in contact with an outer peripheral surface of the rotatable heating member. The belt unit also includes first and second supporting rollers configured to rotatably support the endless belt. The position detecting portion is configured to detect that the endless belt is deviated from a predetermined zone with respect to a widthwise direction of the endless belt. The tilting mechanism includes a second motor as a driving source for tilting the belt unit and is configured to tilt the belt unit in a direction for returning the endless belt to the predetermined zone in response to an output of the position detecting portion. The jam detecting portion is configured to detect occurrence of a jam. When the occurrence of the jam is detected by the jam detecting portion during a tilting operation of the belt unit, the tilting mechanism interrupts and then stops the tilting operation of the belt unit simultaneously with or earlier than an end of a stop of rotation of the rotatable heating member.

According to a further aspect, the present invention provides an image heating apparatus including a rotatable heating member, a first driving portion, a belt unit, a position detecting portion, a tilting mechanism, and a controller. The rotatable heating member is configured to heat a toner image on a recording material. The first driving portion includes a first motor and is configured to rotationally drive the rotatable heating member. The belt unit includes an endless belt configured to heat the rotatable heating member in contact with an outer peripheral surface of the rotatable heating member. The belt unit also includes first and second supporting rollers configured to rotatably support the endless belt. The position detecting portion is configured to detect that the endless belt is deviated from a predetermined zone with respect to a widthwise direction of the endless belt. The tilting mechanism includes a second driving portion which includes a second motor and which is configured to tilt the belt unit. The tilting mechanism is configured to tilt the belt unit in a direction for returning the endless belt to the predetermined zone in response to an output of the position detecting portion. The jam detecting portion configured to detect occurrence of a jam. The controller is configured to control operations of the first and second driving portions. When the occurrence of the jam is detected by the jam detecting portion during a tilting operation of the belt unit, the controller sends a signal for stopping rotation of the rotatable heating member to the first driving portion and sends a signal for stopping the tilting operation of the belt unit by the tilting mechanism to the second driving portion in response to detection of the occurrence of the jam by the jam detecting portion.

Further features of the present invention will become apparent from the following description of exemplary embodiments with reference to the attached drawings.

Figure 6:
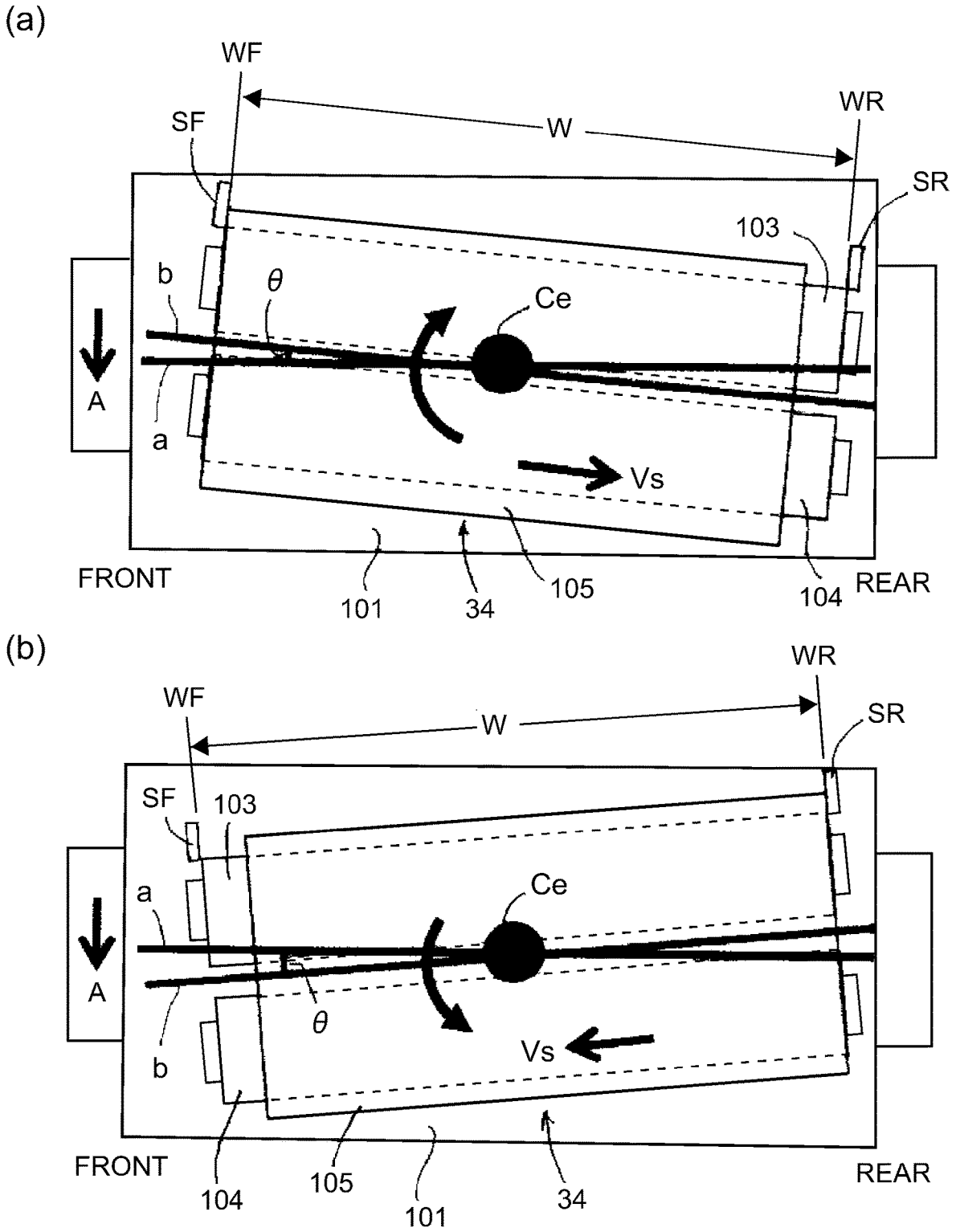

Parts (a) and (b) of FIG. 6 are schematic views showing a shift control operation of an external heating belt.

Figure 7:
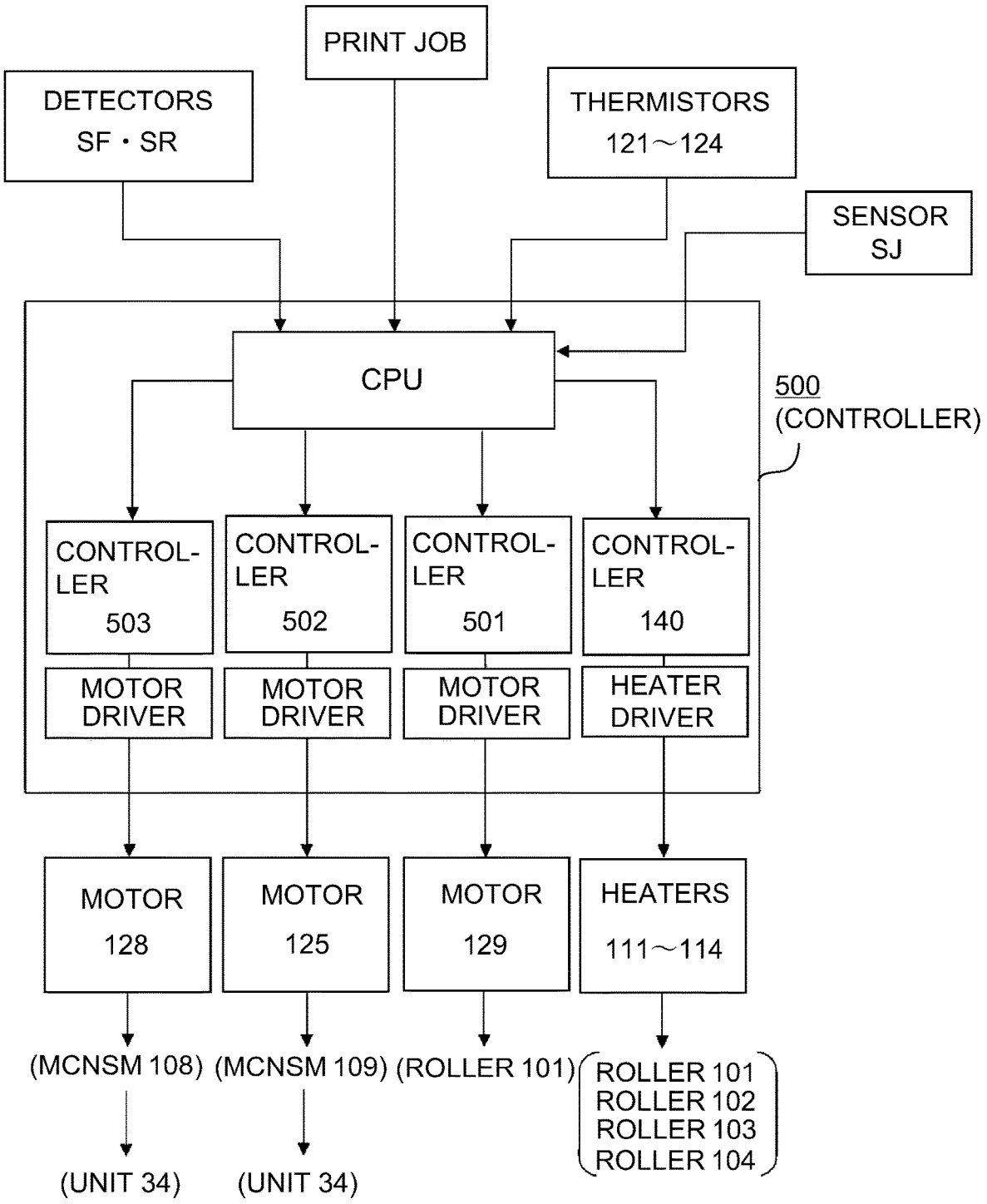

FIG. 7 is a block diagram of a control system.

Figure 8:
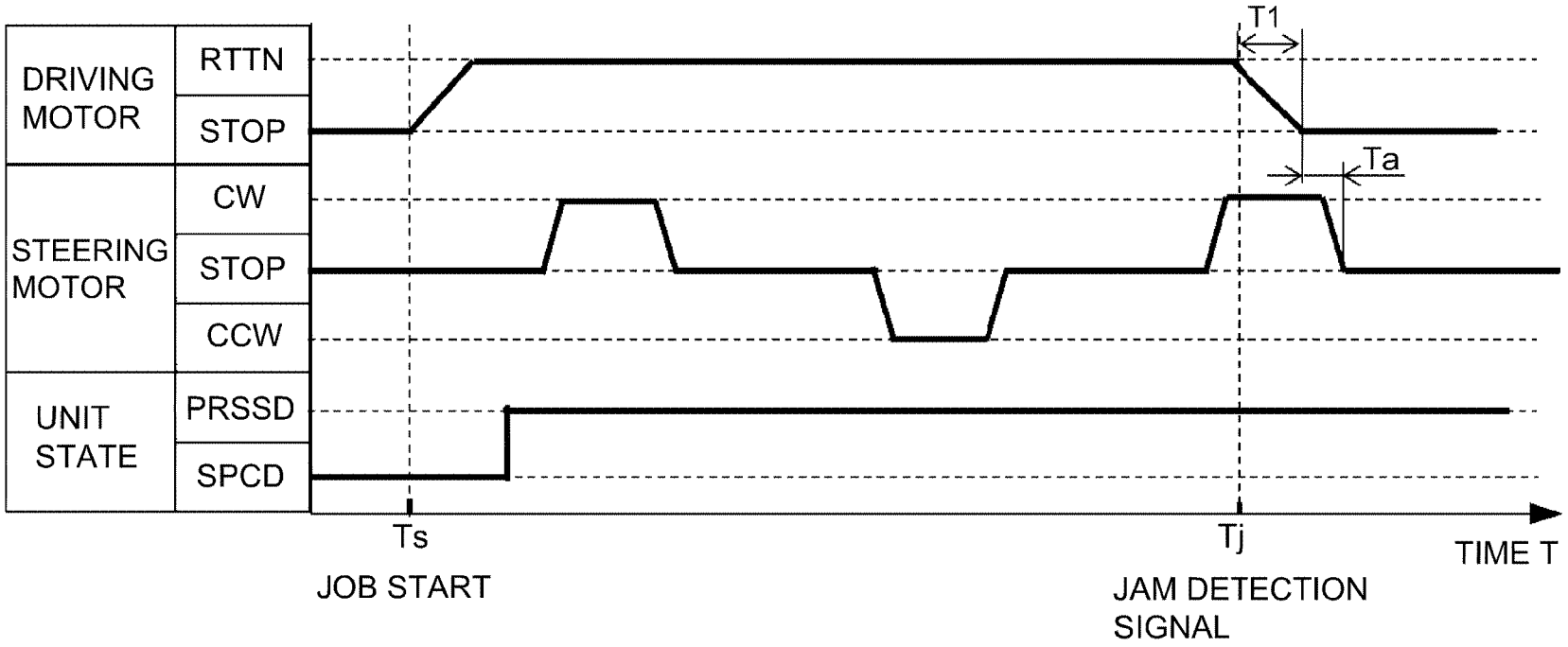

FIG. 8 is a time chart showing an operation of a conventional fixing device.

DESCRIPTION OF EMBODIMENTS

Embodiments of the present invention will be described. The following embodiments are examples of preferred embodiments of the present invention, but the present invention is not limited to the following embodiments.

Embodiment 1

[Image Forming Portion]

Figure 1:
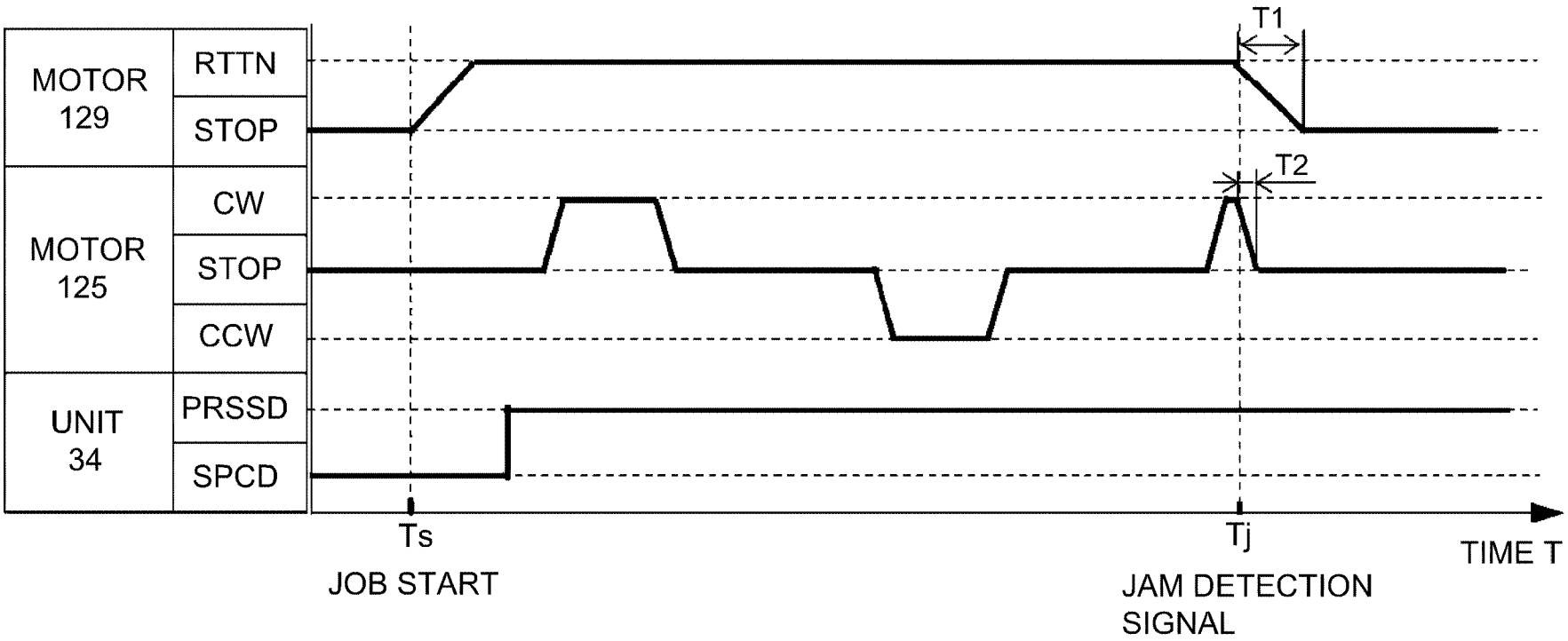
FIG. 1 is a time chart showing an operation of a fixing device in Embodiment 1.

FIG. 1 is a longitudinal, sectional, front view of a full-color electrophotographic printer. The full-color electrophotographic printer shown in FIG. 1 is a tandem type and an intermediary transfer type. The full-color electrophotographic printer shown in FIG. 1 is an example of an image forming apparatus 1 that has a fixing device (image heating apparatus) 15 in accordance with a preferred embodiment of the present invention. A structure of this printer is well known and therefore will be briefly described.

An image forming portion 2 for forming a toner image on a recording material (hereafter referred to as a sheet) P includes four image forming units S (SY, SM, SC, SK). Each of the image forming units S includes an image bearing member (electrophotographic photosensitive drum) 3, a primary charging device 4, an exposure device (laser scanner) 5, a developing device 6, a primary transfer device 7, a cleaner 8, and the like. Incidentally, in order to avoid complication of the figure, reference numerals of these devices other than those of the image forming unit SY are omitted from illustration.

The respective image forming units S form toner images of yellow (Y), magenta (M), cyan (C) and black (K) on the image bearing members 3. Then, the four color toner component images are successively primary-transferred from the image bearing members 3 of the respective image forming units S onto an intermediary transfer member (intermediary transfer belt) 9 in a predetermined superposition manner. As a result, a color toner image including the superposed four color component toner images (Y+M+C+K) is formed on the intermediary transfer member 9.

The toner images formed on the intermediary transfer member 9 are secondary-transferred onto the sheet P at a secondary transfer portion 13. The sheet P is separated and fed one by one from a cassette 10 or 11 and is passed through a feeding path 12, and then is introduced into the secondary transfer portion 13 at predetermined control timing. As a result, the toner images on the intermediary transfer member 9 are secondary-transferred successively onto the sheet P. Then, the sheet P, passed through the secondary transfer portion 13, passes through a feeding path 14 and is guided into a fixing device 15, in which the toner images are fixed on the sheet P under application of heat and pressure.

In the case of a one-side print mode, the sheet P coming out of the fixing device 15 passes through an upper side of a flapper 16 and then is discharged onto a discharge tray 17. In the case of a double-side print mode, the sheet P, which comes out of the fixing device 15 and which has been subjected to one-side printing, is guided into a reversing feeding path 18 by the flapper 16. The sheet P is then subjected to switch-back feeding and thus is guided into a feeding path 19 for double-side printing. Then, the sheet P passes through the feeding path 19 and then passes through the feeding path 12 again. Then, the sheet P is guided into the secondary transfer portion 13 and is subjected to the secondary transfer of the toner images onto a second surface thereof. Thereafter, similarly as in the case of the one-side print mode, the sheet P passes through the path including the feeding path 14, the fixing device 15, and the upper side of the flapper 16, and then the sheet P is discharged as a double-side printed product onto the discharge tray 17.

[Fixing Device]

Figure 4:
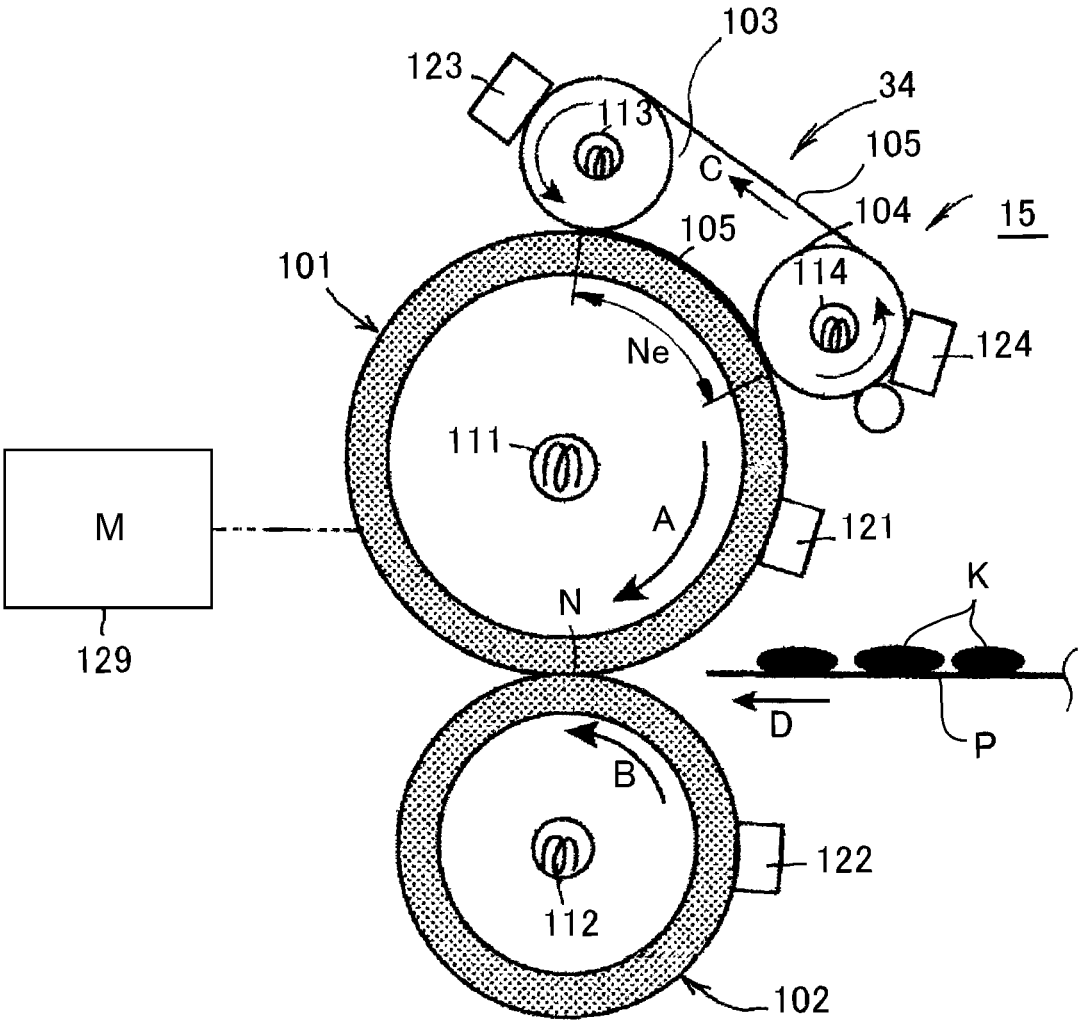
FIG. 4 is a schematic structural view of a fixing device having an external heating structure.
Figure 5:
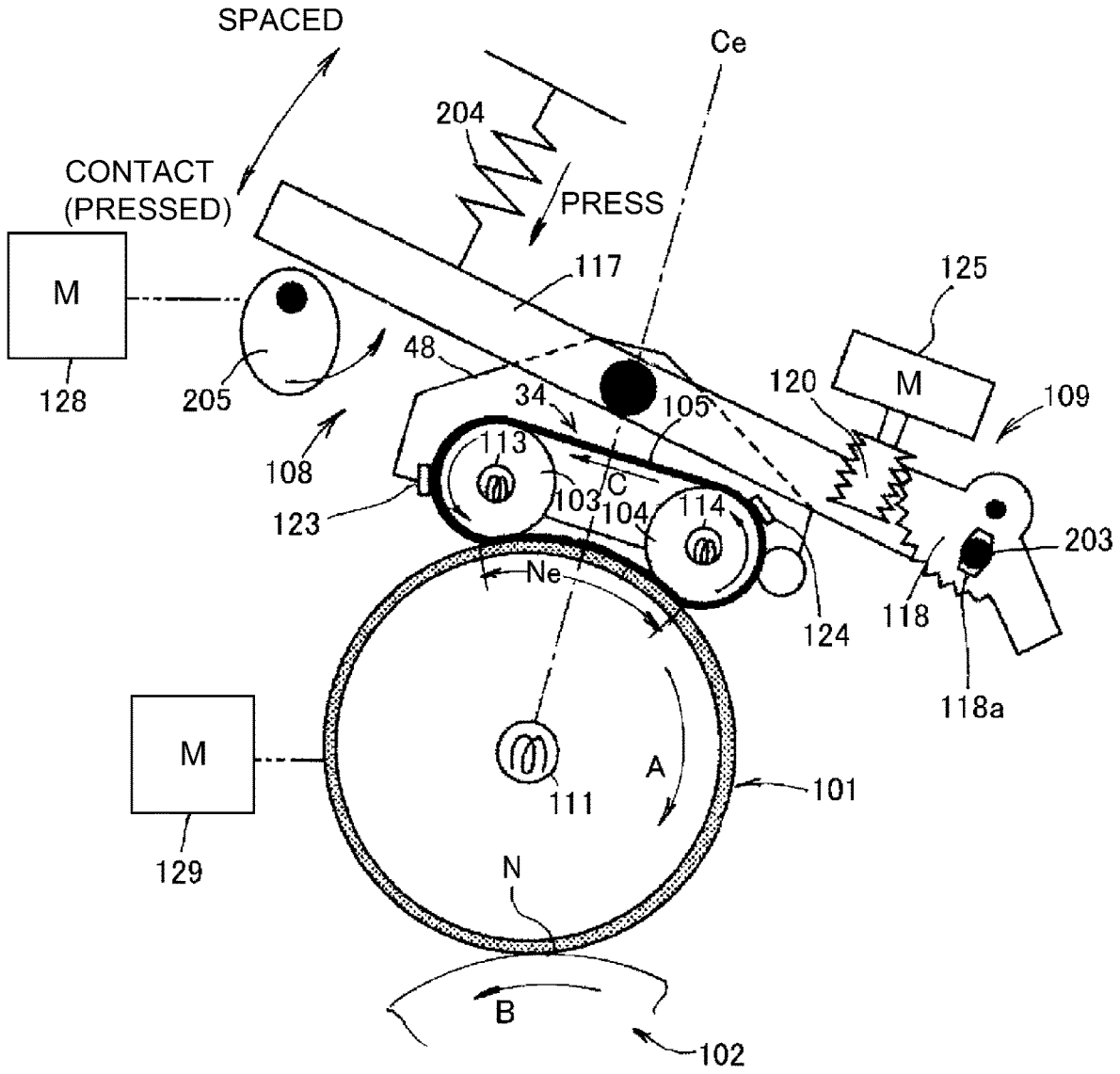
FIG. 5 is a detailed view of the external heating structure.

FIG. 4 is a schematic cross-sectional view of a principal part of the fixing device (image heating apparatus) 15, FIG. 5 is a schematic structural view of an external heating unit, and FIG. 7 is a block diagram of a control system. A mechanism structure of this fixing device 15 is similar to that described in JP-A 2013-190774, and therefore, will be briefly described. The fixing device 15 is of an external heating type using an external heating belt 105. The fixing device 15 roughly includes:

(1) a fixing roller (first rotatable member) 101 as a rotatable heating member (image heating member) for heat-fixing toner images K on a sheet (recording material), (2) a pressing roller (second rotatable member) 102 as a rotatable pressing member (pressing member) for forming a fixing nip N in a cooperation with the fixing roller 101, (3) an external heating unit (external heating belt unit) 34 for heating the fixing roller 101 in contact with an outer surface of the fixing roller 101, and (4) a casing (device frame, not shown) accommodating these members.

Here, with respect to the fixing device 15, or constituent members thereof, a front surface is a surface of the device as seen from a sheet entrance side, a rear surface is a surface on a side (sheet exist side) opposite from the front surface, and left and right are left (one end side) and right (the other end side) when the device is viewed from the front surface (side). Upper and lower are those with respect to a direction of gravitation. Further, with respect to the fixing device 15, or the constituent members thereof, a longitudinal direction (widthwise direction) is a direction parallel to a direction perpendicular to a sheet feeding direction (recording material feeding direction) D on a sheet feeding surface. A short-side direction is a direction parallel to the sheet feeding direction D.

Figure 3:
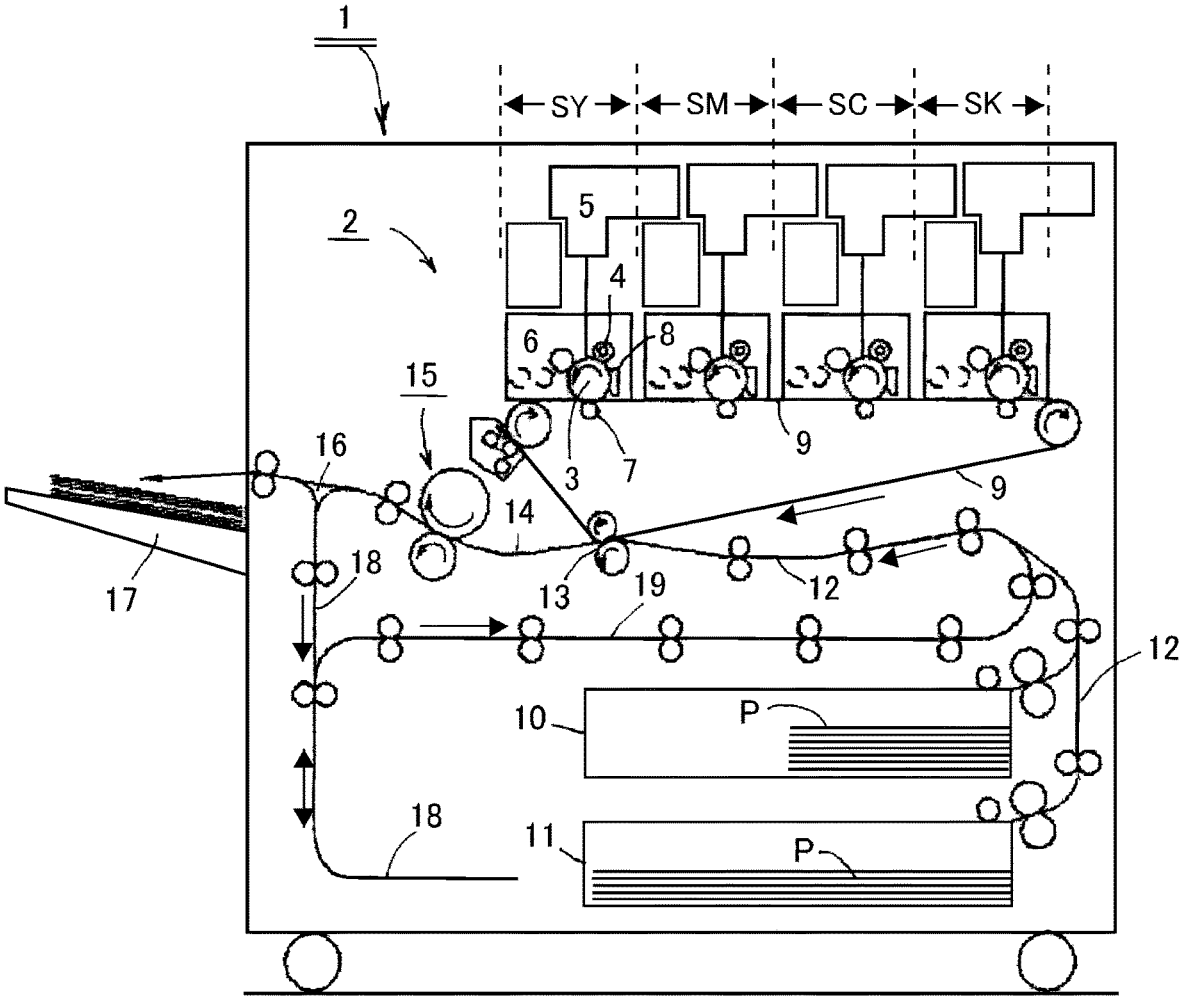
FIG. 3 is a schematic structural view of an example of an image forming apparatus.

As regards the printer 1 in FIG. 3, with respect to a direction perpendicular to the drawing sheet, a front side is the front surface side, and an opposite side is a rear side. The fixing device 15 is mounted inside this printer 1 in a state in which the fixing device 15 extends in a front-rear direction as the longitudinal direction. Therefore, in the following description, a left side which is one end side of the fixing device 15 is referred to as a front side, and a right side which is the other end side of the fixing device 15 is referred to as a rear side.

(Fixing Roller)

The fixing roller 101 is a hollow roller, and an outer peripheral surface of the hollow roller is coated with a parting layer (tube), as a surface layer, formed of a fluorine-containing resin material or the like. End portions of the fixing roller 101 on the front side and the rear side are rotatably provided between side plates of the casing on the front side and the rear side via bearing members. To the fixing roller 101, a driving force of a fixing (device) driving motor (driving means, hereafter referred to as a driving motor) 129 driven by a fixing (device) drive controller 501 in a controller (control means) 500 is transmitted through a drive transmitting mechanism (not shown), so that the fixing roller 101 is rotationally driven in an arrow A direction at a predetermined speed. That is, the fixing driving motor and the drive transmitting mechanism function as a driving portion for rotationally driving the fixing roller 101.

Further, a halogen heater 111, as a heat generating element, is provided inside the fixing roller 101. The heater 111 is turned on by a heater controller 140 of the controller 500 and internally heats the fixing roller 101.

A surface temperature of the fixing roller 101 is detected by a thermistor 121 contacting the fixing roller 101. The thermistor 121 is a temperature detecting means. Detection temperature information, including the temperature of the fixing roller 101 detected by the thermistor 121, is fed back to the controller 500. The heater controller 140 controls (ON/OFF control) turning-on of the heater 111 on the basis of the temperature of the fixing roller 101 detected by the thermistor 121 and thus effects control so that the surface temperature of the fixing roller 101 falls within a predetermined range.

(Pressing Roller)

The pressing roller 102 is a hollow roller, and is disposed under the fixing roller 101 substantially in parallel to the fixing roller 101. End portions of the pressing roller 102 on the front side and the rear side are rotatably provided between side plates of the casing on the front side and the rear side via bearing members. The pressing roller 102 is pressed against the fixing roller 101 at a predetermined pressure by a pressing means (not shown), so that the pressing roller 102 forms the fixing nip N having a predetermined width with respect to the sheet feeding detect D in cooperation with the fixing roller 101, and is rotated in an arrow B direction with rotation of the fixing roller 101.

Further, inside the pressing roller 102, a halogen heater 112 as a heat generating element is provided. The heater 112 is turned on by the heater controller 140 of the controller 500 and internally heats the pressing roller 102. A surface temperature of the pressing roller 102 is detected by a thermistor 122 as a temperature detecting means contacting the pressing roller 102. Detection temperature information is fed back to the controller 500. The heater controller 140 controls (ON/OFF control) turning-on of the heater 112 on the basis of the temperature of the pressing roller 102 detected by the thermistor 122 and thus effects control so that the surface temperature of the pressing roller 102 falls within a predetermined range.

(External Heating Unit)

The external heating unit 34 for heating the fixing roller 101 in contact with the outer surface of the fixing roller 101 enables a fixing process without lowering a fixing speed even when the image is fixed on a sheet having a large basis weight. The external heating unit 34 in this embodiment uses the external heating belt 105 and is characterized in that a large heat conduction amount can be obtained since a contact area, between the fixing roller 101 and the belt 105, relating to heat conduction is large. Hereafter, the external heating unit 34 is referred to as the belt unit 34.

As shown in FIGS. 4 and 5, the belt 105 is an endless belt for heating the fixing roller 101 and is provided in contact with the outer surface of the fixing roller 101 in the belt unit 34. The belt 105 is rotatably stretched by an upstream supporting roller 103 and a downstream supporting roller 104 with respect to a rotational direction A of the fixing roller 101. That is, the belt unit 34 includes the endless belt 105 for heating the fixing roller 101 in contact with the outer surface of the fixing roller 101 and includes the supporting rollers 103 and 104 as a supporting mechanism for rotatably supporting the belt 105.

The supporting rollers 103 and 104 are disposed along the rotational direction A of the fixing roller 101 and perform a function of rotating while stretching the belt 105 in a state in which the supporting rollers 103 and 104 presses the belt 105 against the fixing roller 101. Further, the belt 105 is rotated by the rotation of the fixing roller 101, and the supporting rollers 103 and 104 are constituted so as to be rotated by rotation of the belt 105.

The supporting rollers 103 and 104, in which rotational axes thereof are parallel to each other and which stretch the belt 105, are pressed toward the fixing roller 101 with a predetermined pressure by a pressing portion (pressing means) 204 consist of a pressing spring (urging portion) or the like. As a result, an outer peripheral surface of the belt 105 is press-contacted to an outer peripheral surface of the fixing roller 101. Further, the belt 105 is constituted so that the belt 105 can be contacted to (pressed against)/spaced from (retracted from) the roller 101.

The belt 105 forms an external nip Ne between itself and the fixing roller 101 in a state in which the belt 105 is contacted to the fixing roller 101. The belt 105 is rotatably supported at an inner surface thereof by the supporting rollers 103 and 104 so as to be rotated by rotation of the fixing roller 101 when pressed against the fixing roller 101. The belt 105 heats the fixing roller 101 while being rotated in an arrow C direction at a predetermined peripheral speed by the rotation of the fixing roller 101 in contact with the outer surface of the fixing roller 101.

The supporting rollers 103 and 104 stretching the belt 105 are formed of a cylindrical metal material (aluminum in this embodiment), and inside the supporting rollers 103 and 104, halogen heaters 113 and 114 are provided, respectively, as a heating means (heater). The heaters 113 and 114 are turned on by the heater controller 140 of the controller 500 and internally heat the supporting rollers 103 and 104, respectively. The belt 105 is heated by heat from the supporting rollers 103 and 104.

The surface temperature of the belt 105 is detected by thermistors 123 and 124. Pieces of detection temperature information of these thermistors 123 and 124 are fed back to the controller 500. The heater controller 140 controls turning-on of the heaters 113 and 114 on the basis of the temperature of the belt 105 detected by the thermistors 123 and 124 and thus effects control (temperature adjustment) so that the surface temperature of the belt 105 is a target temperature. By the heat of the belt 105, the surface of the fixing roller 101 is externally heated.

Referring to FIG. 5, the supporting rollers 103 and 104 stretching the belt 105 are rotatably supported by supporting units (bearing plates) 48 on the front side (not shown) and the rear side. These supporting units 48 on the front side and the rear side are attached to a pressing arm 117 rotatably supported about a rotation shaft 203, so that the pressing portion 204 presses the pressing arm 117.

As a result, the supporting rollers 103 and 104 stretching the belt 105 is contacted to the fixing roller 101, so that the belt 105 forms the external nip Ne between itself and the fixing roller 101 in a state in which the belt 105 contacts the fixing roller 101.

Further, a mounting and demounting cam 205 is rotated by an external heating mounting and demounting motor 128 controlled by an external heating mounting and demounting controller 503 of the controller 500 and pushes up the pressing arm 117 against the pressure of the pressing portion 204. As a result, the supporting rollers 103 and 104 are raised from the fixing roller 101 through the supporting unit 48, so that the belt 105 is spaced from the fixing roller 101.

The mounting and demounting motor 128, the mounting and demounting cam 205, the pressing portion 204, the pressing arm 117, and the supporting unit 48 constitute mounting and demounting mechanism (moving mechanism) 108 for supporting the belt unit 34 so as to be contactable to and capable of being spaced from the fixing roller 101. The mounting and demounting mechanism 108 can also be constituted as a mechanism for supporting the fixing roller 101 so as to be contactable to and capable of being spaced from the belt unit 34. That is, the mounting and demounting mechanism 108 is a mechanism (moving mechanism) capable of moving at least one of the belt unit 34 and the fixing roller 101 so that the belt 105 and the fixing roller 101 is movable between a contact position where the belt 105 and the fixing roller 101 are contacted to each other and a spaced position where the belt 105 and the fixing roller 101 are spaced from each other.

During a fixing operation of the fixing device 15, heat is taken from the surface of the fixing roller 101 by the recording material P. Therefore, the controller 500 carries out the external heating of the fixing roller 101 by controlling the mounting and demounting mechanism 108 so that the belt unit 34 is contacted to the fixing roller 101 during passing of the sheet P through the fixing nip N. Then, after the sheet passing, the controller 500 controls the mounting and demounting mechanism 108 so that the belt unit 34 is spaced from the fixing roller 101.

Further, the belt unit 34 has a constitution such that the belt unit 34 is movable (tiltable) so that an axial direction b (generatrix direction of the belt 105) of the supporting rollers 103 and 104 crosses a generatrix direction a (FIG. 6) of the fixing roller 101. A rotation center thereof is Ce (rotational axis) shown in FIGS. 5 and 6, and a rotation range is, as shown in FIG. 6, such that the supporting rollers 103 and 104 are rotatable relative to the fixing roller 101 in both of the clockwise direction and the counterclockwise direction with respect to a parallel position between the fixing roller 101 and each of the supporting rollers 103 and 104.

A steering motor 125, controlled by a steering controller 502 of the controller 500, is rotationally driven, so that a worm gear 120 rotates a sector gear 118. Then, a rotation shaft 203 of the pressing arm 117, supported at an end portion by a long hole 118*a* of the sector gear 118, is moved in a longitudinal direction of the pressing arm 117. As a result, the front side of the belt unit 34 is moved in a tangential direction at a point of intersection between the surface of the fixing roller 101 and the rotational axis Ce. The belt unit 34 rotates about the rotational axis Ce, and therefore, the rear side of the belt unit 34 is moved in a direction opposite to that of the front side of the belt unit 34. That is, the steering motor, the worm gear, the sector gear, and the like function as a driving portion for rotating (tilting) the belt unit 34.

Thus, as shown in FIG. 6, a crossing angle θ generates between the fixing roller 101 and the supporting rollers 103 and 104. The belt 105 is rotated with the surface of the fixing roller 101, and therefore, when the fixing roller 101 rotates in the rotational direction A, a shift speed Vs shown in FIG. 6 generates in the belt 105. The belt 105 shifts in an axial direction of the supporting rollers 103 and 104 and reaches a boundary WF or WR of a predetermined shift width (predetermined zone) W. Then, an end surface of the belt 105 on the front side or the rear side is detected by a detector (for example, a detecting means including a photo-interruptor) provided in the belt unit 34. That is, the detector SF or SR functions as a position detecting portion for detecting that the belt 105 is out of the predetermined zone.

Specifically, with respect to a widthwise direction of the belt 105, the detector SF or SR detects that the belt 105 is out of the predetermined zone W. A detection signal of the detector SF or SR is fed back to the controller 500. The steering controller 502 rotationally drives the steering motor 125 in a normal rotation direction (CW direction) or a reverse rotation direction (CCW direction) by a predetermined angle on the basis of the signal from the detector SF or SR. As a result, the belt unit 34 is rotated about the rotational axis Ce, so that the supporting rollers 103 and 104 pass through a position parallel to the fixing roller 101 and are disposed at a position providing a predetermined crossing angle on an opposite side, and thus the shift direction of the belt 105 is reversed.

That is, when the belt 105 shifts to one side (front side) with respect to the widthwise direction thereof as shown in (a) of FIG. 6, the belt unit 34 is rotated about the rotational axis Ce, so that the belt 105 is shifted to the other side (rear side). On the other hand, when the belt 105 shifts to the other side (rear side), the belt unit 34 is rotated about the rotational axis Ce in the opposite direction, so that the belt 105 is shifted to one side (front side). Such control (swing (type) control) is carried out repetitively, whereby the belt 105 can be swung within the predetermined zone.

The rotational axis Ce, the motor 125, the gear 120, the gear 118, the long hole 118*a*, the rotation shaft 203, and the pressing arm 117 constitute a rotating mechanism (tilting mechanism) 109 for rotating the belt unit 34 in a direction of returning the belt 105 to the predetermined zone, depending on an output of the detector SF or SR. During the fixing operation of the fixing device 15, the controller 500 performs the above-described shift operation control in which the belt 105 reciprocates in the predetermined shift width (zone) W.

(Fixing Operation)

During stand-by in which the printer 1 waits for an input of a print job, the fixing roller 101 of the fixing device 15 is rotated by the driving motor 129. The belt unit 34 is spaced from the fixing roller 101 by a demounting operation of the mounting and demounting mechanism 108. Energization to the heaters 111 to 114 is controlled so that surface temperatures of the respective rollers including the fixing roller 101, the pressing roller 102 and the supporting rollers 103 and 104 are temperature-controlled to predetermined temperatures during a stand-by state. Or, the energization to the heaters 111 to 114 is cut off.

During the stand-by state, the print job is inputted to the controller 500, so that a job starts. The driving motor 129 is controlled by the controller 500 and thus is driven (rotated). As a result, the fixing roller 101 is rotationally driven in the arrow A direction at a predetermined speed. The pressing roller 102 is rotated in the arrow B direction by rotation of this fixing roller 101. The controller 500 causes the mounting and demounting mechanism 108 to perform a mounting operation. As a result, the belt unit 34 is press-contacted to the fixing roller 101. The belt 105 of the belt unit 34 is rotated in the arrow C direction by the rotation of the fixing roller 101. The supporting rollers 103 and 104 are rotated by rotation of the belt 105.

Further, the controller 500 controls the rotating mechanism 109 in response to the output of the detector SF or SR for detecting that the belt 105 is out of the predetermined zone W, so that the belt unit 34 is rotated in the direction of returning the belt 105 to the predetermined zone.

Further, the controller 500 controls the energization of the heaters 111 to 114 so that the surface temperatures of the respective rollers including the fixing roller 101, the pressing roller 102, and the supporting rollers 103 and 104 are changed from the predetermined temperatures during the stand-by state to predetermined temperatures during the fixing operation, and thus, temperature control is carried out. During the stand-by state, when the energization of the heaters 111 to 114 is cut off, the energization is started, so that the surface temperatures of the respective rollers including the fixing roller 101, the pressing roller 102, and the supporting rollers 103 and 104 are increased to the predetermined temperatures during the fixing operation, and thus, the temperature control is carried out.

Then, the sheet P on which the unfixed toner image K is carried is introduced into the fixing nip N formed by the fixing roller 101 and the pressing roller 102, which are controlled to the predetermined temperatures during the fixing operation. The sheet P is heated and pressed by being nipped and fed through the fixing nip N, so that the toner image is heat-fixed on the sheet P. When the fixing operation of a print job (monochromatic printing) of a single sheet or a print job (multiple printing) of a plurality of successive sheets is ended, the fixing device 15 is returned to the above-described stand-by state.

(Operation of Fixing Device During Emergency Stop)

Next, an operation in the case when the fixing device 15 stops due to emergency will be described as a feature of this embodiment. As an example requiring emergency stop of the fixing device 15, the case when a jam of the sheet P occurred is cited.

For example, in the case when the jam such that the toner image sticks to the fixing roller 101 and the sheet P is wound about the fixing roller 101 occurred, the sheet P is wound-up by the fixing roller 101 when the rotation of the fixing roller 101 is not stopped immediately. For this reason, it becomes difficult to remove the jammed sheet P in some cases.

In the case when the jam occurred on a side downstream of the fixing device 15 with respect to the sheet feeding direction, the subsequent sheet runs against the jammed sheet when feeding of a subsequent sheet during feeding at a portion upstream of a jam occurrence portion including the fixing device 15 with respect to the sheet feeding direction is not stopped immediately. Then, the feeding path is clogged with the subsequent sheet, and thus deformation of a guiding plate or the like may occur in some cases. Sensors SJ (FIG. 7) for detecting arrival/passing of the sheet are provided at required portions of the sheet feeding path including the fixing device 15 of the printer 1. Then, a jam detecting means (jam detecting portion) discriminates occurrence or non-occurrence of the jam on the basis of a sheet arrival/passing detection signal from the sensors SJ with sheet feeding in execution of the print job. The sensors SJ and the controller (discriminating portion) 500 function as the jam detecting means (jam detecting portion).

Then, in the case when the controller 500 received a jam detection signal (abnormal signal) from the jam detecting means, the controller 500 stops the print job execution operation of the printer 1 including the fixing operation of the fixing device 15 due to an emergency. Then, the controller 500 causes a display portion (not shown) to display a jam occurrence portion and a message prompting a user to perform a jam clearance.

FIG. 1 shows a pressing/separation (spacing) state of the driving motor 129, the steering motor 125 and the belt unit 34 with respect to the fixing roller 101 in the case when emergency stop of the fixing device 15 occurred during the fixing operation.

When the pint job starts at time Ts, the controller 500 causes the driving motor 129 to start rotational drive and then causes the belt unit 34 to be pressed against the fixing roller 101. The belt 105, rotated by the fixing roller 101, performs a shift operation in which the belt 105 reciprocates in the predetermined shift width W by the above-described shift control. Every detection of the belt end surfaces by the detectors SF and SR, the steering motor 125 is rotationally driven by predetermined angles alternately in the CW direction and the CCW direction correspondingly to the detected end surfaces, and thus the belt unit 34 is rotated, so that the shift direction of the belt 105 is reversed.

At time Tj, when the jam detection signal is received by the controller 500 during the operation of the steering motor 125, stop signals are sent to the drive controller 501 and the steering controller 502, respectively. A rotation system driven by the driving motor 129 is large in inertia, and therefore, the driving motor 129 stops after a lapse of a time T1 from reception of the stop signal. On the other hand, the steering motor 125 rotationally drives the belt unit 34 by the worm gear 120. For this reason, the steering motor 125 is not driven by inertia of the rotation operation of the belt unit 34, and stops after a lapse of a time T2, shorter than the time T1 from reception of the stop signal. That is, in the case when the occurrence of the jam is detected during the rotation operation of the belt unit 34, the controller 500 outputs the stop signal to the steering controller 502 in response to detection of the occurrence of the jam in this embodiment. As a result, the steering controller 502 controls the steering motor 125 functioning as a driving portion of the rotating mechanism 109, and thus stops the rotation operation of the belt unit 34. Specifically, the rotation operation of the belt unit 34 in the rotation operation by the steering motor 125 is interrupted with the occurrence of the jam and then stops earlier than a stop of the rotation operation of the fixing roller 101. As a result, a steering operation is not performed in a state in which the belt unit 34 contacts the fixing roller 101 which stops rotation thereof, and therefore, damage, such as scars or creases (tube creases), is not generated on the surface layer of the fixing roller 101.

Incidentally, at the time Tj, in the case when the rotation operation of the belt unit 34 by the steering motor 125 is not performed, the controller 500 causes the steering motor 125 to be continuously at rest as it is.

Further, in order to suppress overshoot(ing) of the surface temperature of the belt 105, the mounting and demounting mechanism 128 does not operate, so that the belt unit 34 stops in a pressed state by the fixing roller 101 similarly as during the fixing operation.

After the emergency stop due to the jam, a state in which the belt unit 34 kept at the high temperature is contacted to the fixing roller 101 is continued, but the steering operation stops earlier than the stop of the fixing roller 101. For that reason, in a state in which the belt unit 34 contacts the fixing roller 101, which stops rotation thereof, the steering operation is not performed, so that damage, such as scars or creases (tube creases), is not generated on the surface layer of the fixing roller 101.

The above-described emergency stop operation of the fixing device 15 in this embodiment is summarized as follows. That is, in response to detection of the occurrence of the jam during the rotation operation of the belt unit 34, the controller 500 controls the driving motor 129 of the driving portion while causing the mounting and demounting mechanism 108 to maintain a state in which the belt unit 34 is contacted to the fixing roller 101. Further, in this case, the rotation operation of the belt unit 34 by the rotating mechanism 109 is stopped earlier than a stop of the fixing roller 101 (FIG. 1).

In Embodiment 1, a constitution in which, in the case when the occurrence of the jam is detected during the rotation operation of the belt unit 34, the controller 500 outputs the stop signal to the steering controller 502 in response to detection of the occurrence of the jam was described as an example. As in this embodiment, a constitution in which in the case when the occurrence of the jam is detected during the rotation operation of the belt unit 34, in response to the detection of the occurrence of the jam, first, a stop signal is sent to the drive controller 501, and after a lapse of a predetermined time, a stop signal is sent to the steering controller 502 may also be employed. Also, in this case, the controller 500 sends the stop signal to the steering controller 502 in response to at least the detection of the occurrence of the jam. In this embodiment, constitutions of the fixing device 15, the belt unit 34 and the like are common to Embodiments 1 and 2, and only an operation of the fixing device 15 during the emergency stop is different from that of Embodiment 1.

Figure 2:
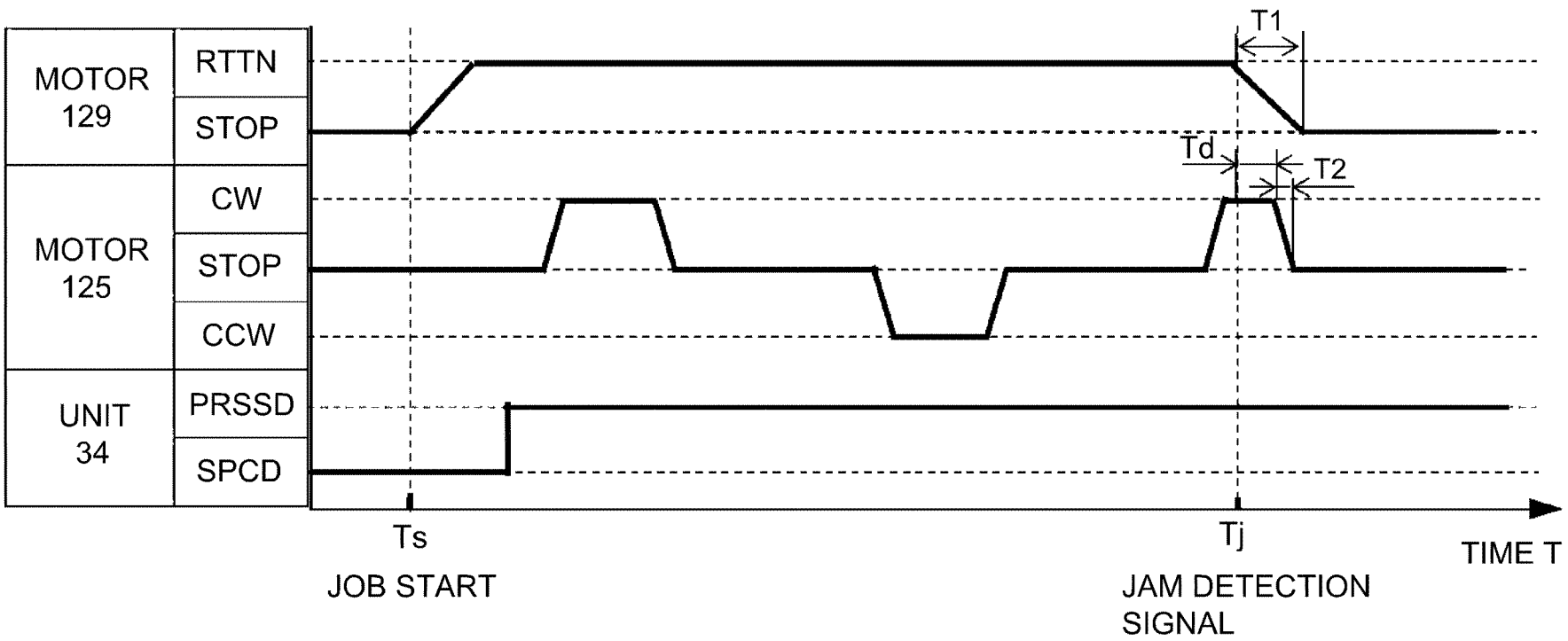
FIG. 2 is a time chart showing an operation of a fixing device in Embodiment 2.

FIG. 2 shows a state of the driving motor 129, a state of the pressing motor 125 and a pressed/spaced state of the belt unit 34 with respect to the fixing roller 101 in the case when the emergency stop of the fixing device 15 generates in this embodiment.

At the time Tj, when the controller 500 receives a jam detection signal during the operation of the steering motor 125, the stop signal is sent to the driving controller 501, so that the driving motor 129 starts reduction of the speed and then stops after a lapse of time T1 from reception of the stop signal.

On the other hand, to the steering controller 502, the stop signal is sent after a lapse of a delay time Td from the time Tj, so that reduction of the speed of the steering motor 125 is started and the steering motor 125 stops after a lapse of a time Td+T2 from the time Tj.

Further, in order to suppress overshoot(ing) of the surface temperature of the belt 105, the mounting and demounting mechanism 128 does not operate, so that the belt unit 34 stops in a pressed state by the fixing roller 101 similarly as during the fixing operation.

At this time, the delay time Td is set so as to satisfy (Td+T2)<T1. The steering motor 125 stops earlier than the driving motor 129, and therefore, the steering operation is not performed in a state in which the belt unit 34 contacts the fixing roller 101 which stops rotation thereof, so that the damage, such as the scars or the creases, is not generated on the surface layer of the fixing roller 101.

Further, the operation of this embodiment exhibits the following effect. In a shift control operation of the belt 105, at a point of a time when the belt end surface is detected with respect to a certain shift direction and drive of the steering motor 125 is started, the shift operation of the belt 105 is continued with respect to the same direction. When the steering motor 125 is rotationally driven and a crossing angle between the belt unit 34 and the fixing roller 101 decreases, the shift speed of the belt 105 lowers, so that when the crossing angle becomes 0, i.e., when the belt unit 34 and the fixing roller 101 are parallel to each other, also the shift speed becomes 0.

At this time, as regards the belt 105, the shift direction thereof is reversed at a position where the belt 105 is further shifted from the position where the belt end surface is detected. Further, when the steering motor 125 is rotationally driven by a predetermined angle and stops with an opposite crossing angle to that before the start of the drive. A single shift reversing operation is completed. At this time, the belt 105 performs a shift operation at a predetermined shift speed Vs in an opposite direction to the direction before the belt end surface is detected.

In the case when the end surface of the belt 105 is detected and the controller 500 receives the jam detection signal immediately after the start of the rotational drive of the steering motor 125, the crossing angle between the belt unit 34 and the fixing roller 101 is not reversed from that at the time of the detection of the end surface of the belt 105. For that reason, when the steering motor 125 is stopped immediately, the shift operation is continued without reversing the shift direction of the belt 105, so that the belt 105 passes through a position where the shift direction of the belt 105 is reversed in normal shift control of the belt 105, and thus a large degree of the shift of the belt 105 generates. In other words, a margin with respect to a complete shift of the belt 105 decreases.

In the operation of this embodiment, even after the controller 500 receives the jam detection signal at the time Tj and the reduction of the speed of the driving motor 129 is started, drive of the steering motor 125 is continued during the delay time Td. For that reason, the steering operation is not performed in a state in which the belt unit 34 contacts the fixing roller 101 which stops the rotation thereof, so that the damage, such as the scars or the creases, is not generated in the surface layer of the fixing roller 101.

Further, when the crossing angle between the belt unit 34 and the fixing roller 101 passes through a parallel position in a period until the steering motor 125 stops, the shift direction of the belt 105 is reversed, so that the margin with respect to the complete shift of the belt 105 is further enlarged.

At this time, the delay time Td is set so as to satisfy (Td+T2)<T1, so that the steering motor 125 stops earlier than the driving motor 129. For that reason, in a state in which the belt unit 34 contacts the fixing roller 101, which stopped rotation thereof, the steering operation is not performed, so that damage, such as the scars or the creases, is not generated on the surface layer of the fixing roller 101.

The above-described emergency stop operation of the fixing device 15 in this embodiment (Embodiment 2) is summarized as follows. That is, in response to detection of the occurrence of the jam during the rotation operation of the belt unit 34, the controller 500 controls the driving motor 129 as the driving portion of the fixing roller 101, whereby reduction of the speed of the rotation operation of the belt unit 34 by the rotating mechanism 109 is started by controlling the steering motor 125, as the driving portion of the rotating mechanism 109, after the reduction of the speed of the rotation operation of the fixing roller 101 is started. Further, the rotation operation of the belt unit 34 is stopped earlier than a stop of the fixing roller 101 (FIG. 2).

Incidentally, at the time Tj, in the case when the rotation operation of the belt unit 34 by the steering motor 125 is not performed, the controller 500 may also cause the steering motor 125 to stop continuously.

Embodiment 3

In Embodiments 1 and 2, a constitution in which the rotation operation of the belt unit 34 is stopped earlier than the stop of the rotation of the fixing roller 101 was employed. The present invention is not limited thereto, but timing when the rotation operation of the belt unit 34 sufficiently stops may also be the same as timing when the rotation of the fixing roller 101 sufficiently stops. Also in this case, the b operation steering is not performed in the state in which the belt unit 34 contacts the fixing roller 101, which stops the rotation thereof, so that the damage, such as the scars or the creases, is not generated on the surface layer of the fixing roller 101.

Other Embodiments

In Embodiments 1 to 3, the case when the fixing device 15 is stopped during the fixing operation was described using the time of the reception of the jam detection signal by the controller 500 as an example, but the present invention is not limited thereto. In the case when the fixing device 15 is stopped during the fixing operation, the fixing device 15 may also be stopped at a time of reception of an error signal by the controller 500 or at a time of reception of another abnormal signal. The error signal is sent, for example, when the thermistors 121, 122, 123 and 124 detect an abnormal temperature.

Further, as the fixing device 15, a device for heat-fixing the unfixed toner image formed on the recording material was described as an example, but the present invention is not limited thereto. For example, the fixing device 15 may also be a device of increasing a gloss (glossiness) of an image by heating and re-fixing a toner image temporarily fixed on the recording material (also, in this case, such a device is referred to as the fixing device or the image heating apparatus).

Further, the fixing device 15 not only has a device constitution in which both of the rotatable heating member 101 and the rotatable driving member 102 are rollers but also can have a device constitution in which one member is an endless belt and the other member is a roller or in which both of the members are endless belts or rollers.

The image forming apparatus is not limited to the full-color image forming apparatus of the electrophotographic type but may also be an image forming apparatus for forming a monochromatic image. Further, the image forming type of the image forming apparatus is not limited to the electrophotographic type, but the image forming apparatus may also be an image forming apparatus for forming the toner image in a direct type or a transfer type by using another type such as an electrostatic recording type or a magnetic recording type.

Further, in the above-described embodiment, as the recording material, the recording paper was described, but the recording material in the present invention is not limited to the paper. In general, the recording material is a sheet-shaped member on which the toner image is formed by the image forming apparatus and includes, for example, regular or irregular members of plain paper, thick paper, thin paper, envelope, post-card, seal, resin sheet, OHP sheet, glossy paper and the like. In the above-described embodiment, for convenience, dealing of the recording material (sheet) P was described using terms, such as the sheet passing, the sheet passing portion, the non-sheet-passing portion, but by this, the recording material in the present invention is not limited to the paper.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image heating apparatus comprising:

a rotatable heating member configured to heat a toner image on a recording material, said rotatable heating member including an outer peripheral surface;

a first motor configured to rotationally drive said rotatable heating member;

a belt unit including (i) an endless belt configured to heat said rotatable heating member in contact with the outer peripheral surface of said rotatable heating member and (ii) a first supporting roller and a second supporting roller, the first supporting roller and the second supporting roller being configured to rotatably support said endless belt;

a position detecting portion configured (i) to detect that said endless belt is deviated from a predetermined zone with respect to a widthwise direction of said endless belt and (ii) to send an output when the position detecting portion detects that said endless belt is deviated from the predetermined zone;

a tilting mechanism including a second motor as a driving source for tilting said belt unit and configured to tilt said belt unit in a direction for returning the endless belt to the predetermined zone in response to the output of said position detecting portion;

a jam detecting portion configured to detect occurrence of a jam; and a controller configured to control said first motor and said second motor, wherein, when the occurrence of the jam is detected by said jam detecting portion during a tilting operation of said belt unit, said controller stops drive of said first motor and stops drive of said second motor in response to detection of the occurrence of the jam by said jam detecting portion.

2. The image heating apparatus according to claim 1, wherein, when the occurrence of the jam is detected by said jam detecting portion during the tilting operation of said belt unit, said controller sends a signal for stopping the drive of said first motor and then sends a signal for stopping the drive of said second motor.

3. The image heating apparatus according to claim 2, wherein, when the occurrence of the jam is detected by said jam detecting portion during the tilting operation of said belt unit, rotation of said second motor stops earlier than rotation of said first motor.

4. The image heating apparatus according to claim 2, wherein, when the occurrence of the jam is detected by said jam detecting portion during the tilting operation of said belt unit, rotations of said first motor and said second motor stop simultaneously.

5. The image heating apparatus according to claim 1, wherein, when the occurrence of the jam is detected by said jam detecting portion during the tilting operation of said belt unit, rotation of said second motor stops earlier than rotation of said first motor.

6. The image heating apparatus according to claim 1, wherein, when the occurrence of the jam is detected by said jam detecting portion during the tilting operation of said belt unit, rotations of said first motor and said second motor stop simultaneously.

7. The image heating apparatus according to claim 1, further comprising a moving mechanism configured to move at least one of said belt unit and said rotatable heating member so that said endless belt and said rotatable heating member are movable between a contact position where said endless belt and said rotatable heating member are contacted to each other and a spaced position where said endless belt and said rotatable heating member are spaced from each other, wherein, when the occurrence of the jam is detected by said jam detecting portion during the tilting operation of said belt unit, said controller stops the drive of said first motor and the drive of said second motor while causing said moving mechanism to maintain a relative position between said endless belt and said rotatable heating member at the contact position.

8. The image heating apparatus according to claim 1, wherein said jam detecting portion includes a sensor and a discriminating portion, said sensor being configured to detect a recording material and to send an output to said discriminating portion, said discriminating portion being configured to discriminate the occurrence of the jam on the basis of the output of said sensor.

9. The image heating apparatus according to claim 1, further comprising a rotatable pressing member configured to form a nip, where a toner image on a recording material is heated, in cooperation with said rotatable heating member.

10. The image heating apparatus according to claim 1, wherein said endless belt is rotated by rotation of said rotatable heating member.

11. An image heating apparatus comprising:

a rotatable heating member configured to heat a toner image on a recording material and configured to be rotationally driven by a first motor, said rotatable heating member including an outer peripheral surface;

a belt unit including (i) an endless belt configured to heat said rotatable heating member in contact with the outer peripheral surface of said rotatable heating member and (ii) a first supporting roller and a second supporting roller, the first supporting roller and the second supporting roller being configured to rotatably support said endless belt;

a position detecting portion configured (i) to detect that said endless belt is deviated from a predetermined zone with respect to a widthwise direction of said endless belt and (ii) to send an output when the position detecting portion detects that said endless belt is deviated from the predetermined zone;

a tilting mechanism including a second motor as a driving source for tilting said belt unit and configured to tilt said belt unit in a direction for returning the endless belt to the predetermined zone in response to the output of said position detecting portion;

a jam detecting portion configured to detect occurrence of a jam, wherein, when the occurrence of the jam is detected by said jam detecting portion during a tilting operation of said belt unit, said tilting mechanism interrupts and then stops the tilting operation of said belt unit simultaneously with or earlier than an end of a stop of rotation of said rotatable heating member.

12. The image heating apparatus according to claim 11, wherein, when the occurrence of the jam is detected by said jam detecting portion during the tilting operation of said belt unit, the tilting operation of said belt unit by said tilting mechanism stops earlier than the end of the stoppage of rotation of said rotatable heating member.

13. The image heating apparatus according to claim 11, wherein, when the occurrence of the jam is detected by said jam detecting portion during the tilting operation of said belt unit, a rotational speed of said tilting mechanism starts to decrease after a speed of the rotatable heating member starts to decrease, and then the tilting operation of said belt unit stops earlier than a stop of rotation of said rotatable heating member.

14. The image heating apparatus according to claim 13, further comprising a controller and the first motor, said controller being configured to control said first motor and said second motor, wherein, when the occurrence of the jam is detected by said jam detecting portion during the tilting operation of said belt unit, said controller sends a signal for stopping the drive of said first motor and a signal for stopping the drive of said second motor in response to detection of the occurrence of the jam by said jam detecting portion.

15. The image heating apparatus according to claim 11, further comprising a moving mechanism configured to move at least one of said belt unit and said rotatable heating member so that said endless belt and said rotatable heating member are movable between a contact position where said endless belt and said rotatable heating member are contacted to each other and a spaced position where said endless belt and said rotatable heating member are spaced from each other, wherein, when the occurrence of the jam is detected by said jam detecting portion during the tilting operation of said belt unit, the tilting operation of said belt unit by said tilting mechanism stops while a relative position between said endless belt and said rotatable heating member is maintained at the contact position.

16. The image heating apparatus according to claim 11, wherein said jam detecting portion includes a sensor and a discriminating portion, said sensor being configured to detect a recording material and send an output to said discriminating portion, said discriminating portion being configured to discriminate the occurrence of the jam on the basis of the output of said sensor.

17. The image heating apparatus according to claim 11, further comprising a rotatable pressing member configured to form a nip, where a toner image on a recording material is heated, in cooperation with said rotatable heating member.

18. An image heating apparatus comprising:

a rotatable heating member configured to heat a toner image on a recording material, said rotatable heating member including an outer peripheral surface;

a first driving portion including a first motor and configured to rotationally drive said rotatable heating member;

a belt unit including (i) an endless belt configured to heat said rotatable heating member in contact with the outer peripheral surface of said rotatable heating member and (ii) a first supporting roller and a second supporting roller, the first supporting roller and the second supporting roller being configured to rotatably support said endless belt;

a position detecting portion configured (i) to detect that said endless belt is deviated from a predetermined zone with respect to a widthwise direction of said endless belt and (ii) to send an output when the position detecting portion detects that said endless belt is deviated from the predetermined zone;

a tilting mechanism including a second driving portion which includes a second motor and which is configured to tilt said belt unit, said tilting mechanism being configured to tilt said belt unit in a direction for returning the endless belt to the predetermined zone in response to the output of said position detecting portion;

a jam detecting portion configured to detect occurrence of a jam; and a controller configured to control operations of said first driving portion and said second driving portion, wherein, when the occurrence of the jam is detected by said jam detecting portion during a tilting operation of said belt unit, said controller sends a signal for stopping rotation of said rotatable heating member to said first driving portion and sends a signal for stopping the tilting operation of said belt unit by said tilting mechanism to said second driving portion in response to detection of the occurrence of the jam by said jam detecting portion.

19. The image heating apparatus according to claim 18, wherein, when the occurrence of the jam is detected by said jam detecting portion during the tilting operation of said belt unit, said tilting mechanism interrupts the tilting operation of said belt unit and then stops the tilting operation earlier than the end of the stoppage of rotation of said rotatable heating member.

20. The image heating apparatus according to claim 18, wherein, when the occurrence of the jam is detected by said jam detecting portion during the tilting operation of said belt unit, said tilting mechanism interrupt the tilting operation of said belt unit and then stops the tilting operation simultaneously with the end of the stoppage of rotation of said rotatable heating member.

* * * * *